US007764265B2

(12) United States Patent
Ko

(10) Patent No.: US 7,764,265 B2
(45) Date of Patent: Jul. 27, 2010

(54) DRIVING APPARATUS FOR DISPLAY DEVICE AND DISPLAY DEVICE INCLUDING THE SAME AND METHOD OF DRIVING THE SAME

(75) Inventor: Hee-Won Ko, Seoul (KR)

(73) Assignee: Samsung Electronics Co., Ltd. (KR)

( * ) Notice: Subject to any disclaimer, the term of this patent is extended or adjusted under 35 U.S.C. 154(b) by 929 days.

(21) Appl. No.: 11/484,950

(22) Filed: Jul. 12, 2006

(65) Prior Publication Data

US 2007/0024554 A1 Feb. 1, 2007

(30) Foreign Application Priority Data

Jul. 26, 2005 (KR) ..... 10-2005-0067707

(51) Int. Cl.
*G09G 3/36* (2006.01)

(52) U.S. Cl. ..... 345/101; 345/211; 345/212

(58) Field of Classification Search ..... 345/55–101, 345/204–214, 690–697
See application file for complete search history.

(56) References Cited

U.S. PATENT DOCUMENTS

| | | | | |
|---|---|---|---|---|
| 5,414,441 | A | 5/1995 | Memarzadeh et al. | 345/87 |
| 6,590,557 | B1 | 7/2003 | Seike | |
| 7,071,929 | B2 * | 7/2006 | Fujii | 345/101 |

FOREIGN PATENT DOCUMENTS

| | | |
|---|---|---|
| CN | 1551077 | 12/2004 |
| JP | 05-088645 | 4/1993 |
| JP | 07-110462 | 4/1995 |
| JP | 08-146390 | 6/1996 |
| JP | 2000-098346 | 4/2000 |
| JP | 2000-321642 | 11/2000 |
| JP | 2000330525 | 11/2000 |
| JP | 2001-215931 | 8/2001 |
| JP | 2002-341835 | 11/2002 |
| JP | 2003-207763 | 7/2003 |
| JP | 2003-319291 | 11/2003 |
| JP | 2004-138969 | 5/2004 |
| JP | 2004-273440 | 9/2004 |
| KR | 1997-029433 | 6/1997 |
| KR | 1020010038237 | 5/2001 |
| KR | 1020010056031 | 7/2001 |
| KR | 1020040061756 | 7/2004 |

* cited by examiner

*Primary Examiner*—David L Lewis
(74) *Attorney, Agent, or Firm*—Cantor Colburn LLP

(57) ABSTRACT

The present invention relates to a driving apparatus for a display device and a display device including the same, as well as a method of driving a display device. The driving apparatus for a display device including a plurality of pixels each with a switching element has a driving voltage generator for generating a first driving voltage at a temperature higher than a reference temperature relative to a predetermined ambient temperature and a second driving voltage higher than the first driving voltage at a temperature lower than the reference temperature, and a gate signal generator for generating a plurality of gate voltages based on the driving voltage. In this manner, power consumption can be reduced by increasing a driving voltage only at a temperature that requires low temperature driving.

16 Claims, 4 Drawing Sheets

DRIVING APPARATUS FOR DISPLAY DEVICE AND DISPLAY DEVICE INCLUDING THE SAME AND METHOD OF DRIVING THE SAME

This application claims priority to Korean Patent Application No. 10-2005-0067707, filed on Jul. 26, 2005, and all the benefits accruing therefrom under 35 U.S.C. §119, and the contents of which in its entirety are herein incorporated by reference.

BACKGROUND OF THE INVENTION (a) Field of the Invention

The present invention relates to a driving apparatus for a display device and a display device including the same, as well as a method of driving the display device. More particularly, the present invention relates to a driving apparatus that reduces power consumption by increasing a driving voltage only at a temperature that requires low temperature driving, and a display device including the same and method of driving the display device.

(b) Description of the Related Art

In recent years, flat panel displays such as organic light emitting diode ("OLED") displays, plasma display panels ("PDPs"), and liquid crystal displays ("LCDs") have been widely developed for use instead of heavy and large cathode ray tubes ("CRTs").

The PDP devices display characters or images using plasma generated by a gas discharge. The OLED display devices display characters or images by applying an electric field to specific light emitting organic or high molecule materials. The LCD devices display images by applying an electric field to a liquid crystal layer disposed between two panels and regulating the strength of the electric field to adjust transmittance of light passing through the liquid crystal layer.

Among the flat panel displays, as examples, the LCD and the OLED devices each include a panel assembly provided with pixels including switching elements and display signal lines, a gate driver providing a gate signal for gate lines of the display signal lines to turn the switching elements on and off, a gate signal generator for generating a gate signal to supply the gate signal to the gate driver, and a driving voltage generator for generating a driving voltage required for generating the gate signal.

Particularly, the driving voltage generator includes a DC/DC converter for generating a driving voltage and a feedback unit receiving the generated driving voltage as a feedback signal.

The gate driver may be integrated in the panel assembly that is formed together with the switching elements. The gate driver includes a plurality of transistors. The plurality of transistors are semiconductor devices, which have characteristics that change according to temperature. In the display devices such as a liquid crystal display, low temperature driving in which operation of the liquid crystal display occurs at sub-zero temperatures becomes a problem. When the ambient temperature decreases, the threshold voltage of the transistors increases. In this case, the switching elements of the pixels are controlled by increasing the amplitude of the driving voltage generated from the DC/DC converter and increasing the absolute value of a gate signal generated from the gate signal driver.

The feedback unit includes a plurality of diodes connected in series, and the feedback unit adjusts the amplitude of the driving voltage according to temperature by feeding back the driving voltage from the DC/DC converter and providing the feedback driving voltage to the DC/DC converter via the diodes. However, the diodes are semiconductor devices as well, so their threshold voltage also changes according to temperature, and the amplitude of the driving voltage is adjusted by sensing this change as well.

However, when the temperature changes and the threshold voltage of the diodes also gradually changes, as discussed above, the threshold voltage increases even at a temperature above zero at which no low temperature driving is required, thereby increasing power consumption. In order to make up for such a problem of unnecessary power consumption when no low temperature driving is required, the number of diodes can be reduced. However, it may then be impossible to obtain a driving voltage required for low temperature driving when the number of diodes are reduced in the feedback unit.

Accordingly, a technical problem to be solved by the present invention is to provide a driving apparatus for a display device that can obtain a driving voltage required for low temperature driving while reducing power consumption, and a display device including the same.

BRIEF SUMMARY OF THE INVENTION

According to an exemplary embodiment of the present invention, there is provided a driving apparatus for a display device having a plurality of pixels each with a switching element, including a driving voltage generator for generating a first driving voltage at a temperature higher than a reference temperature relative to a predetermined ambient temperature and a second driving voltage higher than the first driving voltage at a temperature lower than the reference temperature, and a gate signal generator for generating a plurality of gate voltages based on the first or second driving voltage.

The driving voltage generator may include a first voltage generator for generating a third driving voltage at a temperature higher than the reference temperature and a fourth driving voltage at a temperature lower than the reference temperature, and a second voltage generator for generating the first driving voltage if the third voltage is input and the second driving voltage if the fourth driving voltage is input.

The first voltage generator may include a first transistor connected to a voltage source through at least one resistor, and a second transistor receiving the first driving voltage or the second driving voltage and operating in synchronization with the first transistor.

The reference temperature can be set to a temperature at which a threshold voltage of the first transistor and a voltage of the voltage source are equal.

The first and second transistors may be bipolar junction transistors ("BJTs").

According to an exemplary embodiment of the present invention, a display device is provided that has a plurality of pixels each with a switching element, including a driving voltage generator for generating a first driving voltage at a temperature higher than a reference temperature relative to a predetermined ambient temperature and a second driving voltage higher than the first driving voltage at a temperature lower than the reference temperature, a gate signal generator for generating a plurality of gate voltages based on the first or second driving voltage, and a gate driver receiving the gate voltages from the gate signal generator to apply the same to the switching elements.

The driving voltage generator may include a first voltage generator for generating a third driving voltage at a temperature higher than the reference temperature and a fourth driving voltage at a temperature lower than the reference temperature, and a second voltage generator for generating the first driving voltage if the third driving voltage is input and the second driving voltage if the fourth driving voltage is input.

The first voltage generator may include a first transistor connected to a voltage source through at least one resistor, and a second transistor receiving the first driving voltage or second driving voltage and operating in synchronization with the first transistor.

The reference temperature can be set to a temperature at which a threshold voltage of the first transistor and a voltage of the voltage source are equal.

The first and second transistors may be bipolar junction transistors ("BJTs").

The gate driver may be integrated with the display device.

According to an exemplary embodiment of the present invention, a method of driving a display device is provided that has a plurality of pixels each including a switching element. The method includes generating a first driving voltage at a temperature higher than a reference temperature relative to a predetermined ambient temperature, generating a second driving voltage higher than the first driving voltage generated at a temperature lower than the reference temperature, generating a plurality of gate voltages based on one of the first or second driving voltages, and applying the plurality of gate voltages to the switching elements.

BRIEF DESCRIPTION OF THE DRAWINGS

The above and other features and advantages of the present invention will become more apparent by describing exemplary embodiments thereof with reference to the accompanying drawings, in which.

DETAILED DESCRIPTION OF THE INVENTION

Figure 1:
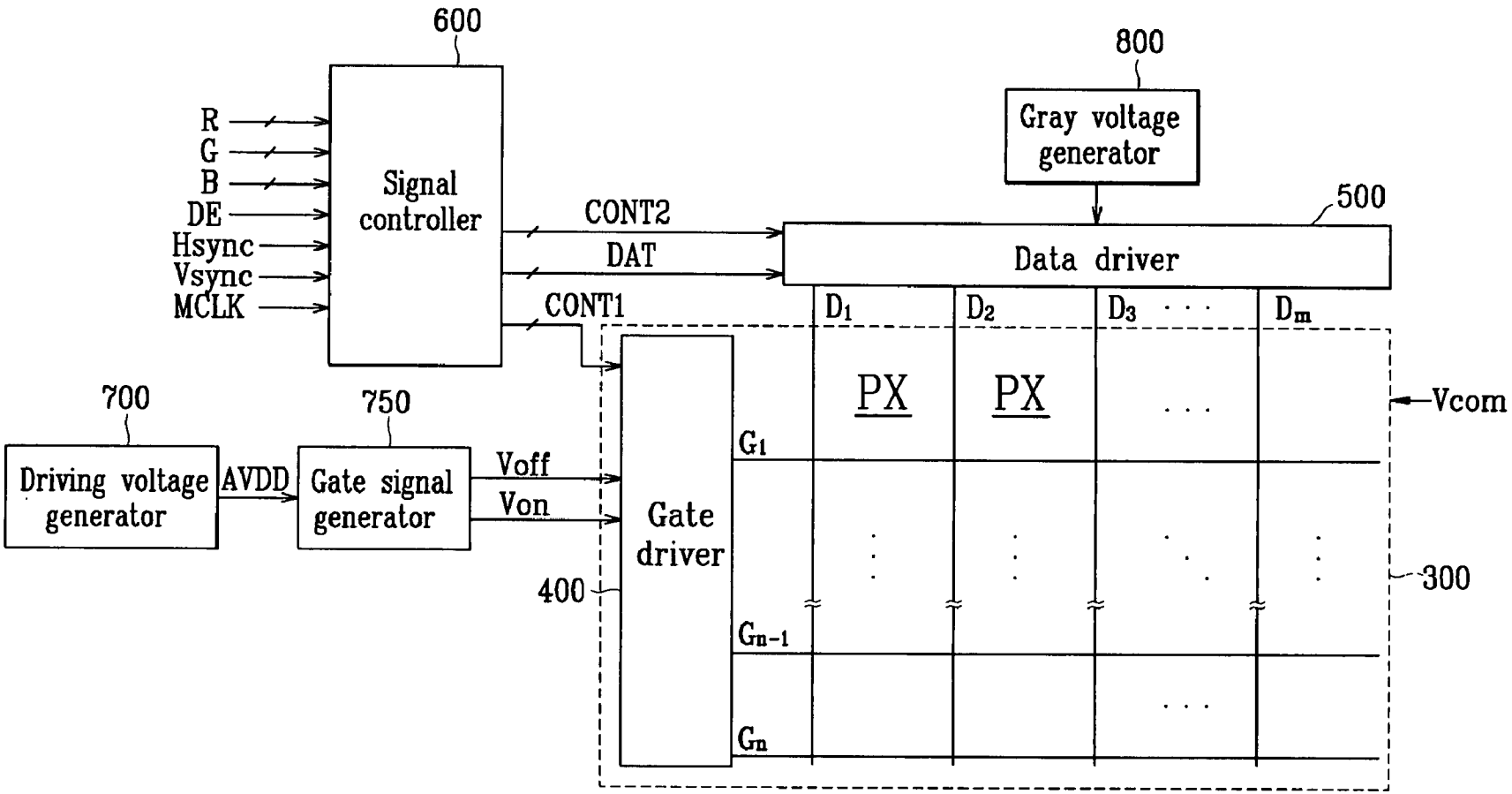
FIG. 1 is a block diagram of an exemplary liquid crystal display device in accordance with an exemplary embodiment of the present invention.

With reference to the accompanying drawings, the present invention will be described in order for those skilled in the art to be able to implement the invention. As those skilled in the art would realize, the described embodiments may be modified in various different ways, all without departing from the spirit or scope of the present invention.

To clarify multiple layers and regions, the thicknesses of the layers are enlarged in the drawings. Like reference numerals designate like elements throughout the specification. When it is said that any part, such as a layer, film, area, or plate is positioned on another part, it means the part is directly on the other part or above the other part with at least one intermediate part. On the other hand, if any part is said to be positioned directly on another part it means that there is no intermediate part between the two parts. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

First, a display device according to an exemplary embodiment of the present invention will be described with reference to FIGS. 1 and 2, and a liquid crystal display device will be described by way of an example.

Figure 2:
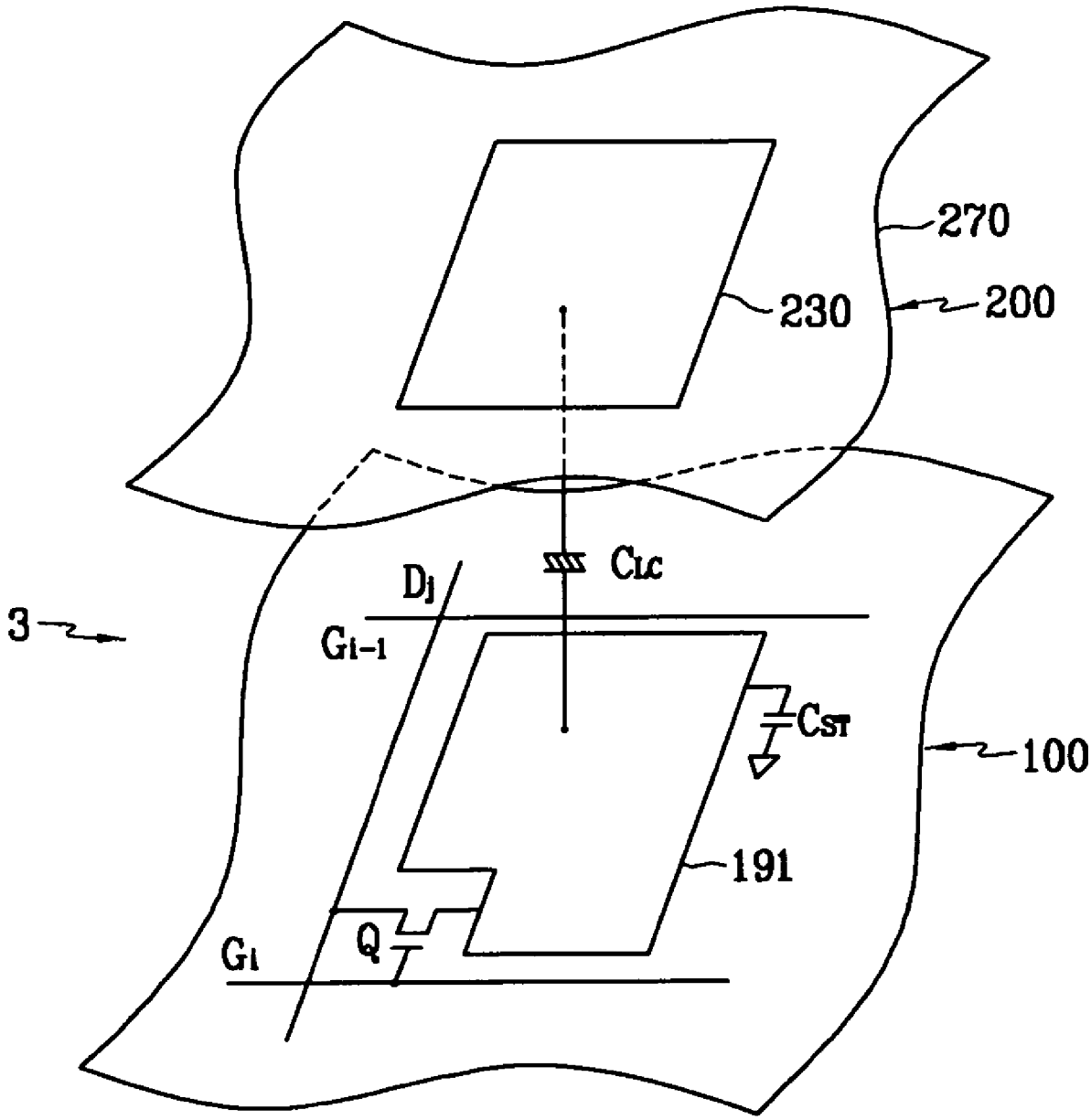
FIG. 2 is an equivalent circuit schematic diagram for one exemplary pixel of the liquid crystal display device in accordance with the exemplary embodiment of the present invention.

FIG. 1 is a block diagram of an exemplary liquid crystal display device in accordance with an exemplary embodiment of the present invention FIG. 2 is an equivalent circuit schematic diagram for one exemplary pixel of the liquid crystal display device in accordance with the exemplary embodiment of the present invention.

As shown in FIG. 1, the exemplary liquid crystal display device according to the exemplary embodiment of the present invention comprises a liquid crystal ("LC") panel assembly 300, a gate driver 400 and a data driver 500 that are connected to the panel assembly 300, a gray voltage generator 800 connected to the data driver 500, and a signal controller 600 for controlling the above elements.

The LC panel assembly 300 includes a plurality of signal lines $G_1$-$G_n$ and $D_1$-$D_m$, and a plurality of pixels PX connected thereto and arranged substantially in a matrix. Meanwhile, the LC panel assembly 300, in the partial structural view shown in FIG. 2, includes a lower panel 100 and an upper panel 200 facing each other, and a liquid crystal layer 3 interposed therebetween.

The signal lines $G_1$-$G_n$ and $D_1$-$D_m$ include a plurality of gate lines $G_1$-$G_n$ for transmitting gate signals (referred to as "scanning signals") and a plurality of data lines ($D_1$-$D_m$) for transmitting data signals. The gate lines $G_1$-$G_n$ extend substantially in a row direction and are substantially parallel to each other, while the data lines $D_1$-$D_m$ extend substantially in a column direction and are substantially parallel to each other, as illustrated in FIG. 1.

Each pixel PX, for example the pixel PX connected to the i-th (e.g., i=1, 2, . . . , n) gate line $G_i$ and the j-th (e.g., j=1, 2, . . . , m) data line $D_j$, includes a switching element Q connected to the signal lines $G_i$ $D_j$, and an LC capacitor $C_{LC}$ and a storage capacitor $C_{ST}$ that are connected to the switching element Q (see FIG. 2). The storage capacitor $C_{ST}$ may be omitted if unnecessary.

The switching element Q, such as a thin film transistor ("TFT"), is provided on the lower panel 100 and has three terminals: a control terminal connected to the gate line $G_i$; an input terminal connected to the data line $D_j$; and an output terminal connected to the LC capacitor $C_{LC}$ and the storage capacitor $C_{ST}$.

The LC capacitor $C_{LC}$ has two terminals, including a pixel electrode 191 on the lower panel 100 and a common electrode 270 on the upper panel 200, with the liquid crystal layer 3 acting as a dielectric between the electrodes 191 and 270. The pixel electrode 191 connected to the switching element Q and the common electrode 270 is formed on the entire surface of the upper panel 100 and is supplied with a common voltage Vcom. Alternatively, unlike that shown in FIG. 2, the common electrode 270 is provided on the lower panel 100, and at least one of the two electrodes 191 and 270 is linear or bar shaped.

The storage capacitor $C_{ST}$ is an auxiliary capacitor for the LC capacitor $C_{LC}$. The storage capacitor $C_{ST}$ includes the pixel electrode 191 and a separate signal line (not shown), which is provided on the lower panel 100. The storage capacitor $C_{ST}$ overlaps the pixel electrode 191 via an insulator, and it is supplied with a predetermined voltage such as the common voltage Vcom. Alternatively, the storage capacitor $C_{ST}$ includes the pixel electrode 191 and an adjacent gate line called a previous gate line, which overlaps the pixel electrode 191 via an insulator.

For color display, each pixel PX uniquely represents one of a plurality of colors, including primary colors, (i.e., spatial division) or each pixel PX sequentially represents the colors in turn (i.e., temporal division) such that a spatial or temporal sum of the colors is recognized as a desired color. An example of a set of the colors includes red, green and blue colors and may also be primary colors. FIG. 2 shows an example of the spatial division in which each pixel PX includes a color filter 230 representing one of the colors in an area of the upper panel 200 facing the pixel electrode 191. Alternatively, unlike that shown in FIG. 2, the color filter 230 is provided on or under the pixel electrode 191 on the lower panel 100.

At least one polarizer (not shown) for polarizing the light is attached on the outer side of the liquid crystal panel assembly 300.

Referring to FIG. 1 again, a driving voltage generator 700 generates a driving voltage AVDD to provide it to a gate signal generator 750, and although not shown, to the gray voltage generator 800 as well.

The gray voltage generator 800 is supplied with the driving voltage AVDD to generate two sets of a plurality of gray voltages (or sets of a plurality of reference gray voltages) related to the transmittance of the pixels. The gray voltages in one set have a positive polarity with respect to the common voltage Vcom, while those in the other set have a negative polarity with respect to the common voltage Vcom.

The gate driver 400 is integrated with the liquid crystal panel assembly 300, and is connected to the gate lines $G_1$-$G_n$ of the LC panel assembly 300 and applies gate signals from the gate signal generator 750 to the gate lines $G_1$-$G_n$. Each gate signal is a combination of a gate-on voltage Von and a gate-off voltage Voff.

The data driver 500 is connected to the data lines $D_1$-$D_m$ of the LC panel assembly 300, and selects gray voltages from the gray voltage generator 800 to apply as data signals to the data lines $D_1$-$D_m$. However, in a case where the gray voltage generator 800 does not provide respective voltages for every gray scale but only provides a predetermined number of reference gray voltages, the data driver 500 divides the reference gray voltages to generate gray voltages for the entire gray scale and selects a data signal from among them.

The signal controller 600 controls the gate driver 400, the data driver 500, etc.

Each of the driving circuits 500, 600 and 800, but not the gate driver 400, may be directly mounted as at least one integrated circuit ("IC") chip on the panel assembly 300 or on a flexible printed circuit film (not shown) in a tape carrier package ("TCP") type, which are attached to the LC panel assembly 300, or may be mounted on a separated printed circuit board (not shown). Alternately, the driving circuits 500, 600 and 800 may be integrated with the panel assembly 300 along with the signal lines $G_1$-$G_n$ and $D_1$-$D_m$ and the TFT switching elements Q. Further, the driving circuits 500, 600 and 800 may be integrated as a single chip. In this case, at least one of them or at least one circuit device constituting them may be located outside the single chip.

Now, the operation of the above-described LCD will be explained.

The signal controller 600 is supplied with input image signals R, G and B and input control signals for controlling the display thereof from an external graphics controller (not shown). The input control signals include, for example, a vertical synchronization signal Vsync, a horizontal synchronization signal Hsync, a main clock signal MCLK, and a data enable signal DE.

After generating gate control signals CONT1 and data control signals CONT2 and processing the image signals R, G and B to be suitable for the operation of the panel assembly 300 on the basis of the input control signals and the input image signals R, G and B, the signal controller 600 provides the gate control signals CONT1 for the gate driver 400, and the processed image signals DAT and the data control signals CONT2 for the data driver 500.

The gate control signals CONT1 include a scanning start signal STV for instructing to start scanning and at least a clock signal for controlling the output time of the gate-on voltage Von. The gate control signals CONT1 may further include an output enable signal OE for defining the duration of the gate-on voltage Von.

The data control signals CONT2 include a horizontal synchronization start signal STH for informing of start of data transmission for a group of pixels, a load signal LOAD for instructing to apply the data signals to the data lines $D_1$-$D_m$, and a data clock signal HCLK. The data control signals CONT2 may further include an inversion signal RVS for reversing the polarity of the voltages of the data signals with respect to the common voltage Vcom (hereinafter, "the polarity of the voltages of the data signals with respect to the common voltage" is abbreviated as "the polarity of the data signals").

In response to the data control signals CONT2 from the signal controller 600, the data driver 500 receives digital image signals DAT for a row of pixels from the signal controller 600, converts the digital image signals DAT into analog data signals by selecting gray voltages corresponding to the respective digital image signals DAT, and applies the digital image signals DAT to the data lines $D_1$-$D_m$.

The gate driver 400 applies the gate-on voltage Von to the gate lines $G_1$-$G_n$ in response to the gate control signals CONT1 from the signal controller 600, thereby turning on the switching elements Q connected thereto. The data voltages applied to the data lines $D_1$-$D_m$ are supplied to the pixels through the turned-on switching elements Q.

The difference between the voltage of the data signals applied to a pixel PX and the common voltage Vcom is expressed as a charged voltage of the LC capacitor $C_{LC}$, e.g., a pixel voltage. The liquid crystal molecules have orientations depending on a magnitude of the pixel voltage to change the polarization of light passing through the liquid crystal layer 3. The change of the polarization is converted into that of the light transmittance by the polarizer attached to the LC panel assembly 300.

By repeating this procedure by a unit of the horizontal period (which is denoted by "1H" and is equal to one period of the horizontal synchronization signal Hsync and the data enable signal DE), all gate lines $G_1$-$G_n$ are sequentially supplied with the gate-on voltage Von, thereby applying the data signals to all pixels to display an image of one frame.

When the next frame starts after finishing one frame, the inversion control signal RVS applied to the data driver 500 is controlled such that the polarity of the data signals is reversed (which is referred to as "frame inversion"). The inversion control signal RVS may also be controlled such that the polarity of the data signals flowing in a data line in one frame are reversed (for example, line inversion and dot inversion) according to the characteristics of the inversion control signal RVS, or the polarity of the data signals applied to a row of pixels are reversed (for example, column inversion and dot inversion).

Next, an exemplary driving circuit of a display device according to an exemplary embodiment of the present invention will be described with reference to FIGS. 3 to 5.

Figure 3:
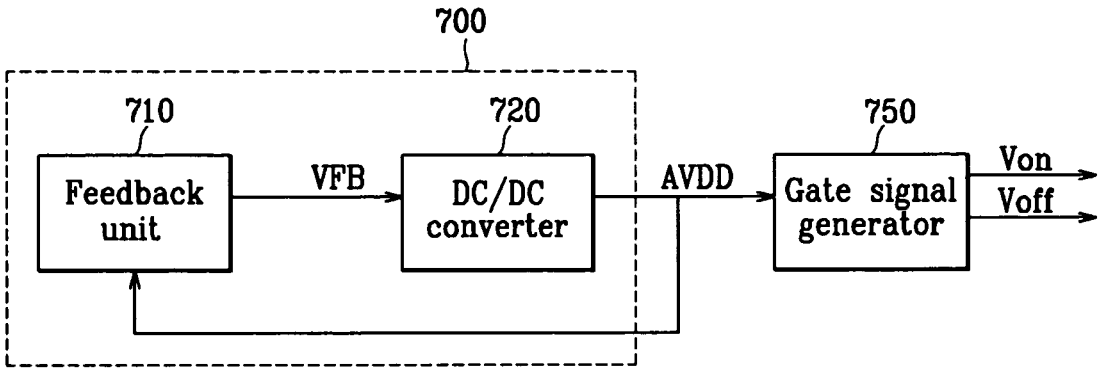
FIG. 3 is a block diagram of an exemplary driving voltage generator as illustrated in FIG. 1 in accordance with an exemplary embodiment of the present invention.

FIG. 3 is a block diagram of an exemplary driving voltage generator as illustrated in FIG. 1. FIG. 4 is a circuit schematic diagram of an exemplary feedback unit as illustrated in FIG. 3. FIG. 5 is a graph comparing a driving voltage generated from the exemplary driving apparatus for the display device according to the exemplary embodiment of the present invention and a driving voltage generated from a driving apparatus for a display device according to the prior art.

Referring to FIG. 3, the exemplary driving voltage generator 700 according to the exemplary embodiment of the present invention includes a feedback unit 710 and a DC/DC converter 720 connected thereto. The DC/DC converter 720 generates a driving voltage AVDD to provide to the gate signal generator 750 and to the feedback unit 710. The feedback unit 710 is supplied with the driving voltage AVDD to generate a feedback voltage VFB depending on temperature and to output the feedback voltage VFB to the DC/DC converter 720. The DC/DC converter 720 generates a driving voltage AVDD depending on the amplitude of the feedback voltage VFB. If the amplitude of the feedback voltage VFB is higher than a previous input image, the DC/DC converter 720 provides a high driving voltage AVDD, and if the amplitude of the feedback voltage VFB is lower than a previous input voltage, it provides a low driving voltage AVDD.

Figure 4:
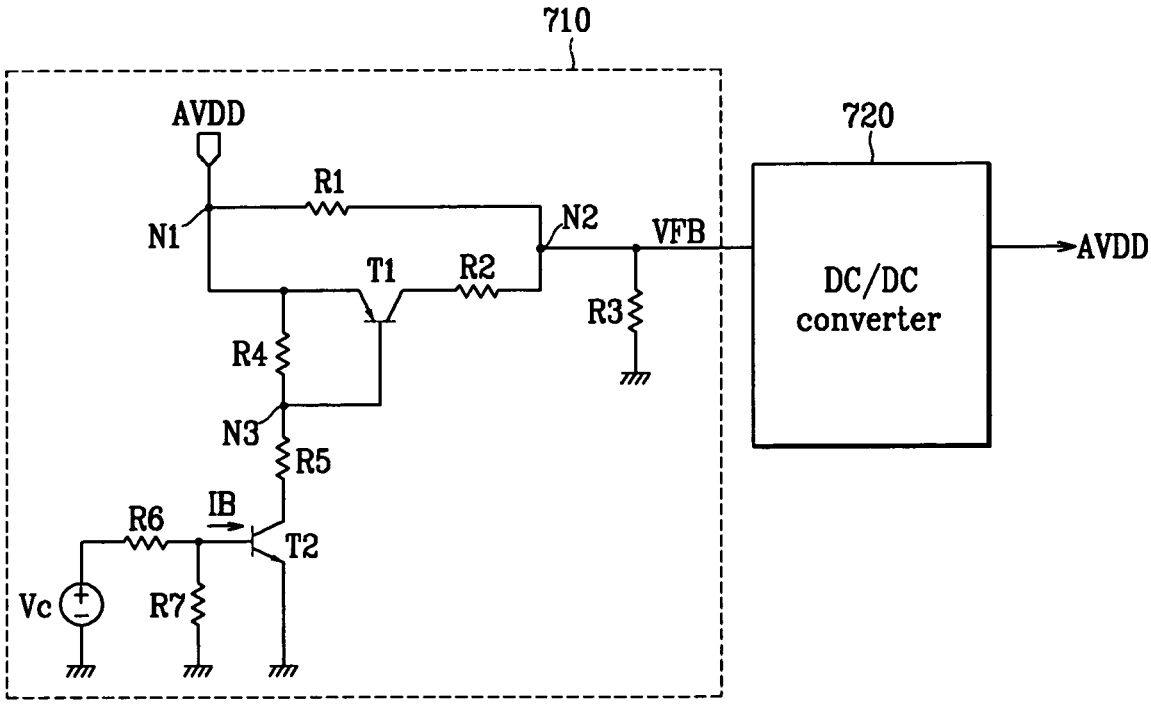
FIG. 4 is an example of a circuit schematic diagram of an exemplary feedback unit as illustrated in FIG. 3 in accordance with an exemplary embodiment of the present invention.

Referring to FIG. 4, the exemplary feedback unit 710 according to the exemplary embodiment of the present invention includes a plurality of transistors T1 and T2 and resistors R1-R7. The transistor T1 is a pnp type of bipolar junction transistor, and the transistor T2 is a npn type of bipolar junction transistor. Alternatively, the transistors T1 and T2 may be the opposite (e.g., T1=npn type and T2=pnp type) or the same type (e.g., T1 and T2=both npn type or both pnp type). Alternatively, the transistors T1 and T2 may be metal-oxide semiconductor ("MOS") transistors.

The resistor R1 is connected in parallel with the transistor T1 and the resistor R2 between node N1 and node N2. The resistor R4 is connected between node N1 and node N3, and the resistor R5 and the transistor T2 are connected between node N1 and ground. The two resistors R6 and R7 are connected in parallel to the base of the transistor T2, and a source voltage Vc is connected to one end of the resistor R6. In addition, the resistor R3 is connected between node N2 and an input of the DC/DC converter 720, and node N1 is connected to an output of the DC/DC converter 720.

The operation of the feedback unit 710 will now be described below.

First, the transistor T1 and T2 have respective threshold voltages existing between an emitter and the base at room temperature, and the threshold voltages are denoted by reference numerals Vth1 and Vth2 for transistors T1 and T2, respectively.

The base current IB of the transistor T2 shown in the drawings can be expressed as follows in Equation 1.

$$IB=(Vc-Vth2)/Req1 \quad \text{(Equation 1)}$$

Here, Req1 is an equivalent resistance of the two resistors R6 and R7 connected to the base of transistor T2 in parallel.

When the transistor T2 is in a turned on state, a current flowing through the resistor R5, i.e., a collector current of the transistor T2, is outputted from node N3, and the current flowing through the resistor R5 equals the sum of the current flowing through the resistor R4 and the base current of the transistor T1. That is, since the base current of the transistor T1 flows, the transistor T1 is in a turned on state as well.

At this point, the feedback voltage VFB1 is expressed as follows in Equation 2.

$$VFB1=(AVDD)*R3/(Rthev+R3) \quad \text{(Equation 2)}$$

Here, Rthev is a Thevenin equivalent resistance of a left side circuit when viewed from the resistor R3. That is, since the transistors T1 and T2 may equivalently replaced with a voltage source and an auxiliary current source, as is well known in the art, the Thevenin equivalent resistance Rthev can be calculated by first obtaining a Thevenin equivalent resistance of a left side circuit with respect to the resistor R2 and then calculating a resistance value of serial and parallel combination of the resistors R1, R2, and an equivalent resistor having the above-obtained Thevenin equivalent resistance. Accordingly, it can be seen that the equivalent resistance Rthev is smaller than the resistance of the resistor R1.

As explained above, the threshold voltages Vth1 and Vth2 of the two transistors T1 and T2, respectively, change according to temperature, and particularly, when the temperature decreases, the threshold voltages Vth1 and Vth2 increase.

For example, if the temperature gradually decreases and the threshold voltage Vth2 becomes equal to a source voltage Vc, the base current IB of the transistor T2 becomes 0 as shown in Equation 1, thereby turning off the transistor T2. Accordingly, a current flowing through the resistor R5, i.e., a collector current of the transistor T2, becomes 0 as well.

As a result, the transistor T1 is also turned off. If it is assumed that the base current of the transistor T1 flows through the resistor R4, the voltage of node N1 equals a driving voltage AVDD, the voltage at both ends of the resistor R4 equals a value obtained by multiplying the base current of the transistor T1 by the resistor R4, and the voltage of node N3 is higher than the driving voltage AVDD by the voltage at both ends of the resistor R4. However, the potential difference between the two nodes N1 and N3, i.e., the voltage at both ends of the resistor R4, equals a voltage difference between the emitter and the collector of the transistor T1. This voltage is higher in the emitter side, which causes inconsistency. Therefore, when the transistor T2 is turned off, the transistor T1 is also turned off.

Consequently, the current caused from the driving voltage AVDD flows toward the node N1, the resistor R1 and the node N2, since both transistors T1 and T2 are turned off. Accordingly, the feedback voltage VFB2 is expressed as follows in Equation 3.

$$VFB2=AVDD*R3/(R1+R3) \quad \text{(Equation 3)}$$

When Equation 2 and Equation 3 are compared, it can be seen that the resistance of the resistor R1 is greater than the resistance Rthev, and thus the feedback voltage VFB2 is smaller. Accordingly, since the amplitude of the driving voltage AVDD becomes higher as the feedback voltage VFB becomes lower, the DC/DC converter 720 generates a higher driving voltage AVDD.

The temperature at which the base current IB of the transistor T2 becomes 0, i.e., the temperature at which the threshold voltage Vth2 of the transistor T2 equals the source voltage Vc, can be set arbitrarily. That is, the amplitude of the driving voltage AVDD generated by turning off the two transistors T1 and T2 at a desired temperature (e.g., at a low temperature) can be adjusted by adjusting the amplitude of the source voltage Vc. For example, this temperature is within the range of about 10 to about 30 degrees below zero degrees Celsius (0° C.) (e.g., about −10° C. to about −30° C.), and the driving voltage AVDD can be generated relative to this temperature.

Figure 5:
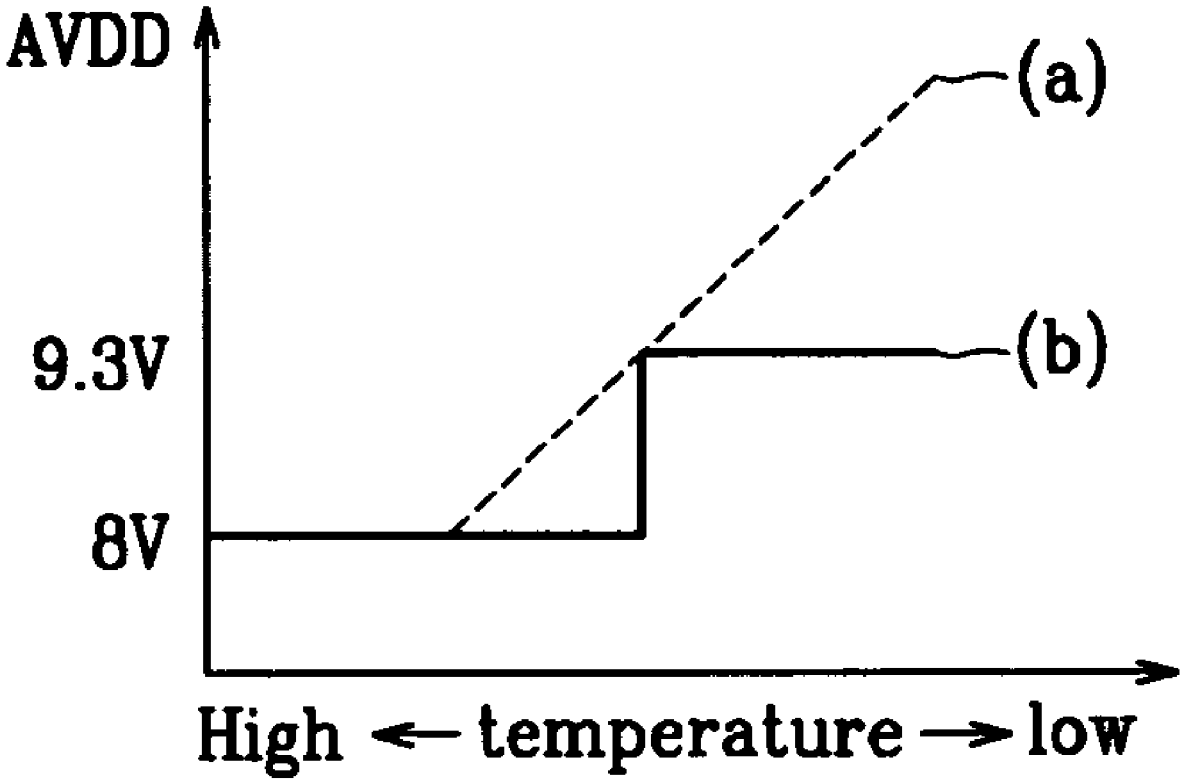
FIG. 5 is a graph showing the amplitudes of a driving voltage depending on temperature in accordance with an exemplary embodiment of a driving apparatus according to the present invention, and a driving voltage generated from a driving apparatus for a display device according to the prior art.

Referring to FIG. 5, (a) is a graph showing the amplitude of a driving voltage AVDD depending on temperature according to the prior art, and (b) is a graph showing the amplitude of an exemplary driving voltage AVDD depending on temperature according to the exemplary embodiment of the present invention.

It can be seen that the driving voltage AVDD increases according to temperature in the graph (a) according to the prior art, while the exemplary driving voltage AVDD increases at a specific temperature in the graph (b) according to the exemplary embodiment of the present invention. Accordingly, in the prior art driving method, the driving voltage AVDD increases as the temperature decreases, and therefore power consumption increases even at a temperature at which no low temperature driving is required. To the contrary, in the exemplary driving method of the present invention, the driving voltage AVDD is kept constant until a specific predetermined temperature is reached, and the driving voltage AVDD only increases at a temperature below the temperature at which low temperature driving is required, thereby enabling a reduction of power consumption.

In this manner, the amplitude of the driving voltage AVDD is only increased at a temperature below a specific predetermined temperature by adjusting the amplitude of the source voltage Vc, thereby preventing an increase of power consumption.

While the present invention has been described in connection with what is presently considered to be practical exemplary embodiments, it is to be understood that the present invention is not limited to the disclosed exemplary embodiments, but, on the contrary, is intended to cover various modifications and equivalent arrangements included within the spirit and scope of the appended claims.

What is claimed is:

1. A driving apparatus for a display device, which includes a plurality of pixels each including a switching element, comprising:

a driving voltage generator for generating a driving voltage, the driving voltage being a first driving voltage generated at a temperature higher than a reference temperature relative to a predetermined ambient temperature and being a second driving voltage higher than the first driving voltage generated at a temperature lower than the reference temperature; and a gate signal generator for generating a plurality of gate voltages based on the driving voltage, wherein the first driving voltage has a constant value at a temperature higher than a reference temperature and the second driving voltage has a constant value higher than the first driving voltage at a temperature lower than the reference temperature.

2. The apparatus of claim 1, wherein the driving voltage generator comprises:

a first voltage generator for generating a third driving voltage at a temperature higher than the reference temperature and a fourth driving voltage at a temperature lower than the reference temperature; and a second voltage generator for generating the first driving voltage if the third voltage driving is input and the second driving voltage if the fourth driving voltage is input.

3. The apparatus of claim 2, wherein the first voltage generator comprises:

a first transistor connected to a voltage source through at least one resistor; and a second transistor receiving the first driving voltage or the second driving voltage and operating in synchronization with the first transistor.

4. The apparatus of claim 3, wherein the reference temperature is set to a temperature at which a threshold voltage of the first transistor and a voltage of the voltage source are equal.

5. The apparatus of claim 4, wherein the first and second transistors are bipolar junction transistors.

6. A display device including a plurality of pixels each including a switching element, the display device comprising:

a driving voltage generator for generating a driving voltage, the driving voltage being a first driving voltage generated at a temperature higher than a reference temperature relative to a predetermined ambient temperature and being a second driving voltage higher than the first driving voltage generated at a temperature lower than the reference temperature;

a gate signal generator for generating a plurality of gate voltages based on the driving voltage; and a gate driver for receiving the gate voltage from the gate signal generator to apply the same to the switching elements, wherein the first driving voltage has a constant value at a temperature higher than a reference temperature and the second driving voltage has a constant value higher than the first driving voltage at a temperature lower than the reference temperature.

7. The display device of claim 6, wherein the driving voltage generator comprises:

a first voltage generator for generating a third driving voltage at a temperature higher than the reference temperature and a fourth driving voltage at a temperature lower than the reference temperature; and a second voltage generator for generating the first driving voltage if the third voltage is input and the second driving voltage if the fourth driving voltage is input.

8. The display device of claim 7, wherein the first voltage generator comprises:

a first transistor connected to a voltage source through at least one resistor; and a second transistor receiving the first driving voltage or the second driving voltage and operating in synchronization with the first transistor.

9. The display device of claim 8, wherein the reference temperature is set to a temperature at which a threshold voltage of the first transistor and a voltage of the voltage source are equal.

10. The display device of claim 9, wherein the first and second transistors are bipolar junction transistors.

11. The display device of claim 10, wherein the gate driver is integrated with the display device.

12. A method of driving a display device, which includes a plurality of pixels each including a switching element, the method comprising:

generating a first driving voltage at a temperature higher than a reference temperature relative to a predetermined ambient temperature;

generating a second driving voltage higher than the first driving voltage generated at a temperature lower than the reference temperature;

generating a plurality of gate voltages based on one of the first or second driving voltages; and applying the plurality of gate voltages to the switching elements, wherein the first driving voltage has a constant value at a temperature higher than a reference temperature and the second driving voltage has a constant value higher than the first driving voltage at a temperature lower than the reference temperature.

13. The method of claim 12, further comprising:

generating a third driving voltage at a temperature higher than the reference temperature and a fourth driving voltage at a temperature lower than the reference temperature using a first voltage generator; and generating the first driving voltage if the third voltage driving is input and the second driving voltage if the fourth driving voltage is input using a second voltage generator.

14. The method of claim 13, wherein the first voltage generator comprises:

a first transistor connected to a voltage source through at least one resistor; and a second transistor receiving the first driving voltage or the second driving voltage and operating in synchronization with the first transistor.

15. The method of claim 14, further comprising setting the reference temperature to a temperature at which a threshold voltage of the first transistor and a voltage of the voltage source are equal.

16. The method of claim 15, wherein the first and second transistors are bipolar junction transistors.

* * * * *